United States Patent [19]

Cameron

[11] 4,357,991

[45] Nov. 9, 1982

[54] HEAT EXCHANGER HAVING IMPROVED TUBE LAYOUT

[75] Inventor: Gordon M. Cameron, Willowdale, Canada

[73] Assignee: C-I-L Inc., North York, Canada

[21] Appl. No.: 120,064

[22] Filed: Feb. 11, 1980

[30] Foreign Application Priority Data

Nov. 23, 1979 [CA] Canada ..... 340568

[51] Int. Cl.[3] ..... F28D 7/10; F28F 12/08

[52] U.S. Cl. ..... 165/159

[58] Field of Search ..... 176/78; 165/159–161, 165/158

[56] References Cited

U.S. PATENT DOCUMENTS 1,790,828 2/1931 McKnight ..... 165/161

2,162,871 6/1939 Tuley et al. ..... 165/161

FOREIGN PATENT DOCUMENTS 521604 2/1956 Canada ..... 165/161

*Primary Examiner*—William R. Cline

*Assistant Examiner*—Theophil W. Streule, Jr.

*Attorney, Agent, or Firm*—Rogers, Bereskin & Parr

[57] ABSTRACT

A heat exchanger having a disc and doughnut baffle configuration, in which the tubes are laid out in a set of concentric rings. Each ring of a set contains the same number of tubes as each other ring of the set, and the tubes in each ring are spaced uniformly apart. Each tube in each ring is located circumferentially midway between the two adjacent tubes of each neighboring ring and is separated from each of the two adjacent tubes in each adjacent ring by a ligament distance h. The distance h is held constant for all tubes in the set, by varying the radial spacing between rings, and the distance between any two adjacent tubes in any ring of the set is made greater than or equal to 2 h. The ligament gaps h which are constant therefore determine the minimum flow area between adjacent rings, and therefore the mass flow velocity through the tube bundle is constant.

12 Claims, 6 Drawing Figures

HEAT EXCHANGER HAVING IMPROVED TUBE LAYOUT

This invention relates to heat exchanger having an improved tube layout.

Various standard tube layouts are presently used in heat exchangers. A particularly common arrangement currently used is the so called triangular layout, in which the tubes are arranged in straight parallel rows and form equilateral triangles with each other as seen in section. A second common arrangement is the square pitch layout, in which the tubes are arranged in squares as seen in section. In addition, in some heat exchangers a variable tube count is used, in which the tubes are arranged in concentric rings as seen in section, with the number of tubes per ring varied to produce a constant flow area between any two adjacent tubes in each ring.

The standard triangular tube layout arrangement has been relatively satisfactory for simple segmental baffle heat exchangers, but has been unsatisfactory for heat exchangers having baffles arranged in the so called disc and donut configuration. In the triangular layout certain flow paths offer less resistance than others, resulting in uneven heat transfer. In addition as the fluid flows radially inwardly, velocities increase and a significant and undesirable pressure drop occurs. Prediction of the heat transfer rate is difficult under such circumstances.

The square pitch tube layout has the same disadvantages as the triangular layout for disc and donut baffled heat exchangers and in addition is less efficient, requiring a larger heat exchanger for the same number of tubes. The variable tube count layout (concentric rings with tube count per ring varied for constant flow area) is also inefficient and further, the fluid flow paths between the tubes are difficult to predict, some being low resistance paths and some being high resistance paths.

Accordingly, the invention provides, for a heat exchanger, an improved tube layout which produces more constant mass flow velocities in the area near the tubes and in which the heat transfer coefficient and pressure drop are more favorable than in the previous arrangement. In its broadest aspect the invention provides, in a heat exchanger having a plurality of tubes of circular cross-section, said tubes all having the same outer diameter, the improvement wherein said tubes are laid out according the following relationship: said tubes are arranged with their centres located on a plurality of concentric circular arcs, a plurality of tubes on each arc; the number of tubes in each arc differs from the number of tubes in each other arc by not more than one; the tubes in each arc are spaced uniformly apart along such arc; each tube in each arc, other than such end tubes as may be present in some of said arcs, is located circumferentially midway between the two adjacent tubes of each neighboring arc so that the centres of such three tubes form an isosceles triangle, each such tube in each arc being separated from each of said adjacent tubes in each adjacent arc by a ligament distance h, said distance h being constant for all said tubes; and the distance between two adjacent tubes in any said arc is at least as great as twice said ligament distance h.

When the tubes are laid out in the manner indicated above, it is found that the exchanger acts in a nearly ideal fashion and calculation of flows and of heat transfer rates is much simplified.

Further objects and advantages of the invention will appear from the following description, taken together with the accompanying drawings, in which.

Figure 1:
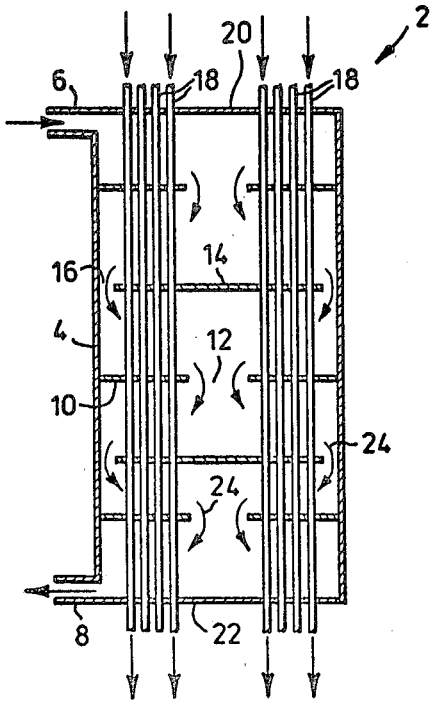
FIG. 1 (PRIOR ART)
FIG. 1 is a diagrammatic view of a typical prior art heat exchanger, illustrating a disc and donut baffle configuration.

Reference is first made to FIG. 1, which shows diagrammatically a typical cylindrical heat exchanger 2. The heat exchanger 2 has a cylindrical shell 4 having an inlet conduit 6 and an outlet conduit 8 for fluid which is to be heated or cooled. Located within the shell 4 are a number of annular or donut shaped baffles 10 which extend to and are fixed to the wall of the shell and which have central apertures 12. Located between each pair of donut baffles 10 is a disc-shaped baffle 14, of smaller diameter than that of the shell 10 and therefore leaving an annular gap 16 extending there around. Both sets of baffles 10, 14, are intersected by all the tubes 18 of the heat exchanger. The tubes 18 extend parallel to the shell 4 and at right angles to the baffles 10, 14. Heating or cooling fluid (liquid or gas) from a source not shown, is directed into the tubes 18 of the heat exchanger from outside one tube sheet 20 and leaves the tubes 18 at the outside of the other tube sheet 22. Fluid (liquid or gas) from the conduit 6 passes through the heat exchanger in the path indicated by arrows 24 and is warmed or cooled by the fluid in the tubes 18. In some cases the central aperture 12 and the annular gap 16 are made sufficiently large that the baffles 10, 14 intersect only some of the tubes 18.

Figure 2:
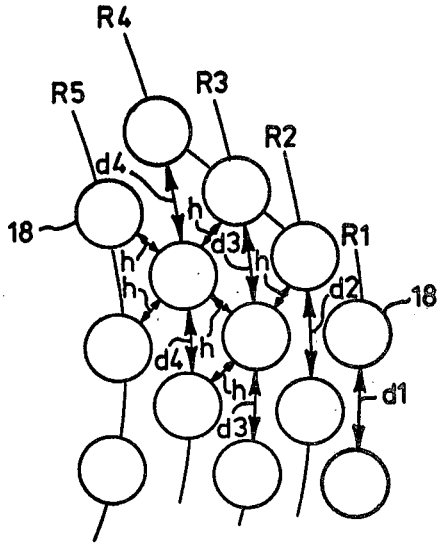
FIG. 2 is a view of a portion of a tubesheet of a heat exchanger in which the invention is used, showing the layout of the tubes.

Reference is next made to FIG. 2, which shows a set of tubes 18 according to the invention. The tubes 18 are shown as being located in rings identified by their radii, namely rings R1, R2, R3, R4 and R5.

The design parameters used to lay out the tubes 18 include the following. Firstly, the diagonal distance between each tube in any ring and its adjacent tubes in the neighboring ring is a constant distance h (referred to as the ligament size or ligament width). Secondly, the shortest distance between two adjacent tubes in the same ring (such distances are identified by reference characters $d_1$, $d_2$, etc.) is a constant in each ring but varies from ring to ring and is always greater than or equal to 2h. Thirdly the number of tubes in each ring is always the same. However, the radial distance between rings is varied so that the ligament size h between a tube in one ring and its adjacent tubes in each neighboring ring is as mentioned always the same. A mathematical design procedure for calculating the various radii will be set forth shortly.

It will be seen from FIG. 2 that so long as the ligament gaps h adjacent to a tube 18 are no more than half as large as the gaps $d_1$, $d_2$, etc., the ligament gaps and not the gaps $d_1$, $d_2$, etc. will determine the maximum fluid velocity near that tube. This is the opposite of the conventional concentric ring arrangement in which the tube count is varied for constant distance between the tubes of a ring. It will also be seen from FIG. 2 that the total minimum flow area through which fluid must pass as it travels radially inwardly through rings $R_1$, $R_2$, $R_3$, etc. is the distance 2h multiplied by the number of tubes per ring (the product is termed the area factor constant or AFC) multiplied by the distance between baffles. As indicated, since the AFC is never greater than the sum of the distances between the tubes of any one ring, the maximum velocity through the rings is determined by the AFC, which is constant between each pair of adjacent rings in the set.

Figure 3:
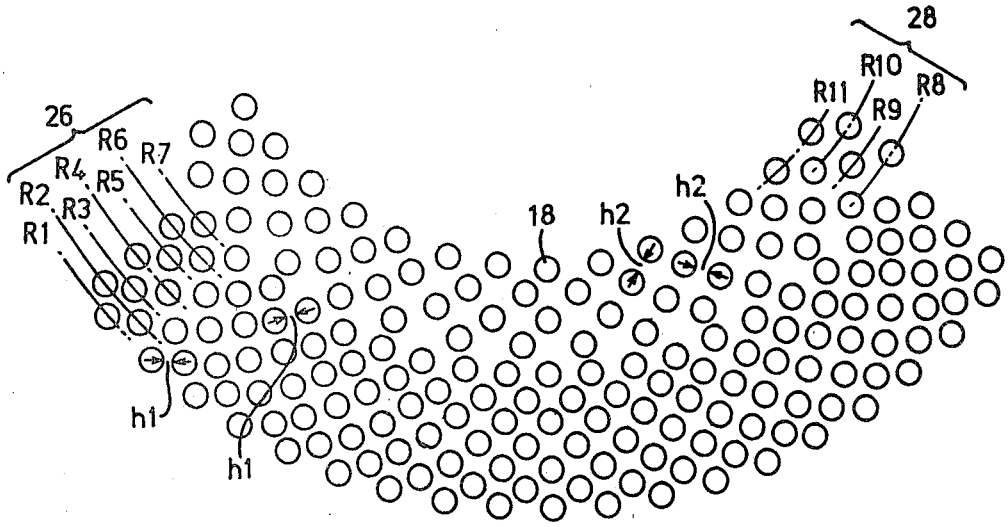
FIG. 3 is a view of a more complete portion of a tubesheet showing the layout of tubes therein according to the invention.

A more complete tube sheet drawing is shown in FIG. 3. FIG. 3 illustrates portions of two sets of circular rings, indicated at 26 and 28. In set 26 the ligament size h1 between each tube 18 and its adjacent tubes 18 in each neighboring ring is always the same constant distance, and the number of tubes 18 in each ring R1 to R7 is the same. In tube set 28, the ligament size h2 between each tube 18 and its adjacent tubes in each neighboring ring is also a constant, but ligament size distance h2 is greater than ligament size h1. The number of tubes in each ring R8 to R11 is constant, but this number is less than the number of tubes in each ring R1 to R7. However the controlling flow distance or AFC between the tubes of any two adjacent rings of set 26 is the same as the controlling flow distance or AFC between the tubes of any two adjacent rings of set 28. In other words distance h1 multiplied by the number of tubes in any ring of set 26 is equal to distance h2 multiplied by the number of tubes in any ring of set 28. Therefore fluid flowing through tube sets 26, 28 will always be subject to the same controlling AFC and the flow velocities through both sets of rings 26, 28 will be nearly constant. The AFC between the adjacent rings of sets 26, 28 will of course normally be greater than the AFC of each of the two sets.

With the design shown in FIGS. 2 and 3, there are no "end" tubes whose performance is influenced by the proximity of the shell. All tubes in each ring are subjected to nearly the same conditions. Mass flow velocities are nearly constant throughout the tube bundle, because the areas between adjacent sets of rings are constant (except at the boundary between sets) In addition, very efficient "packing" of tubes is achieved.

A further advantage of the arrangement shown is that since the tube bundle can readily be fitted into a circular vessel, maximum utilization of the available space in the vessel can be achieved. Since the flow resistance is substantially uniform in each path, uniform flow distribution is provided, which produces minimum tube to tube temperature variations. This reduces the maximum principle stress variations in the tube bundle.

A mathematical procedure for laying out the tubes will now be discussed, with reference to FIG. 4.

Figure 4:
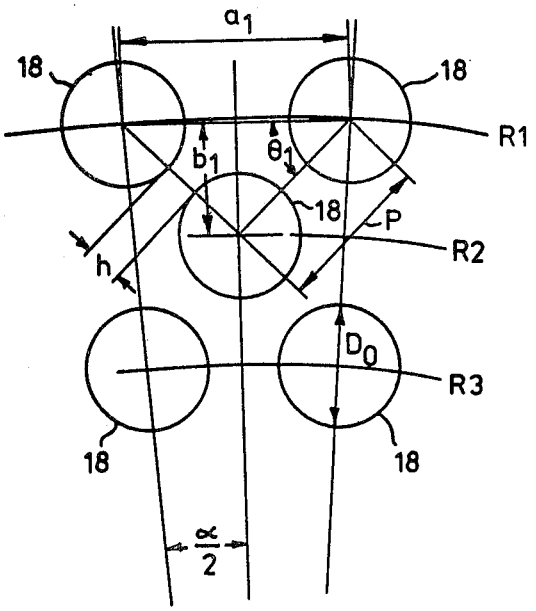
FIG. 4 is a view showing the layout of five tubes according to the invention and illustrating the mathematical design by which the tubes are laid out.

As shown in FIG. 4, the following quantities have the following meanings:

- h is the diagonal distance between each tube and the adjacent tubes in each neighboring ring, or in other words is the ligament width,
- n is the ring number,
- $R_1$, $R_2$, $R_3$–$R_n$ are the ring radii,
- $\alpha$ is the angle between radii directed through the centres of adjacent tubes in a ring,
- $a_n$ is a chord of the circle having radius $R_n$ extending between the centres of two adjacent tubes on the circle of radius $R_n$,
- $D_o$ is the outer diameter of each tube, assumed to be the same for all tubes,
- $N_{tr}$ is the number of tubes per ring, assumed to be the same for all rings in each set of rings,
- P is the pitch, i.e. the distance between the centres of adjacent tubes in adjacent rings, and is to be constant.

Then with reference to FIG. 4:

$$h=P-D_o, \tag{1}$$

$$\alpha/2=(180/N_{tr}) \text{ degrees}, \tag{2}$$

$$a_n/2=P\cos\theta_n=R_n\sin(\alpha/2). \tag{3}$$

The radius $R_{n+1}$ is related to radius $R_n$ by $$R_{n+1}+b_n=R_n\sin(\alpha/2) \tag{4}$$

In practice, the design may be started by selecting the required area for flow, i.e. the AFC, which is $2hN_{tr}$. If a ligament width h is chosen, this determines the number of tubes for the first ring of radius $R_1$, which is laid out adjacent the shell 4 of the heat exchanger.

Once $N_{tr}$ is chosen, this yields a value for $\alpha/2$ and for chord $a_1$, which with the value of h sets a value for $\theta_1$. Since $b_1=P\sin\theta_1$, this yields a value for $b_1$, so that $R_2$ can be calculated.

There are certain limits applicable to the values that may be chosen. Firstly, as discussed, the minimum flow area between adjacent rings is to be limited by the ligaments h and not by the gaps $d_1$, $d_2$, etc. Therefore $$a_n=D_o\geqq 2h \tag{5}$$

As will be explained, equation (5) results in the limit $$R\ min \geqq \frac{D_o+2h}{2\sin\frac{180}{N_{tr}}} \tag{6}$$

Equation (6) gives the minimum ring radius which may be used in order to satisfy equation (5).

The derivation of equation (6) is as follows with reference to FIG. 5.

Assuming that $a_n\geqq D_o+2h$

Therefore $(a_n/2)=R_n\sin(\alpha/2)$

Hence $2R_n\sin(\alpha/2)\geqq D_o+2h$ $$\text{or } R\ min \geqq \frac{D_o+2h}{2\sin\frac{180}{N_{tr}}} \tag{6}$$

If the minimum ring radius is less than R min, the chord distance between two adjacent tubes in the same ring will be less than twice the ligament width, so that the minimum flow area will no longer be governed by the ligaments, which is undesirable. It will however be appreciated that when a number of rings of tubes are to be packed into a heat exchanger, and if space considerations so demand, one or more of the inner rings can be more tightly packed, so that the chord distance between two adjacent tubes in ring is in fact less than 2h. This of course has the disadvantage that the flow through these rings will not behave as ideally as the flow through the rings laid out as described. Such rings, where the chord distance is less than 2h, would not be considered as being members of the set of rings laid out according to the invention. Similarly an outer ring or rings can be provided near the shell with tube spacings other than those described, to provide higher or lower heat transfer near the shell wall.

The second limit for tubes laid out as described is as follows. It is normally necessary to ensure that the radial distance between any two rings which are separated by one ring is greater than the pitch, i.e. that $R_n - R_{n-2} \geqq P$. This results in the limit (7) $\theta_n = 30° - (180/N_{tr})$ degrees for the largest radius ring, i.e. ring $R_1$.

The derivation of equation (7) is as follows. Since it has been postulated, with reference to FIG. 5, that $$c_1 + b_2 \geqq P$$

and since $c_1 = P \cos \phi$ where $\phi = 90° - (\theta_1 + (\alpha/2))$

Hence $$\text{Hence } C_1 = P \cos\left[90° - \left(\theta_1 + \frac{\alpha}{2}\right)\right] = P \sin\left(\theta_1 + \frac{\alpha}{2}\right)$$

$$\text{And } b_2 = \left[P^2 - \left(\frac{a_2}{2}\right)^2\right]^{\frac{1}{2}}$$

Where $$a_2/2 = P \sin \phi = P \cos (\theta + \alpha/2)$$

Hence $$P \sin (\theta_1 + \alpha/2) + P[1 - \cos^2 (\theta_1 + \alpha/2)]^{\frac{1}{2}} \geqq P$$

For $$\theta_1 + \alpha/2 < 90°,$$

we have $$2 \sin (\theta_1 + \alpha/2) \geqq 1$$

or $$\sin (\theta_1 + \alpha/2) \geqq \tfrac{1}{2}$$

or $$\theta_1 + \alpha/2 \geqq 30°$$

Since $$\alpha/2 = 180/N_{tr}$$

Therefore $$\theta_1 \geqq 30° - 180/N_{tr} \qquad (7)$$

Equation (7) represents a normal limit on how closely the rings can be spaced without unduly weakening the tube sheets 20, 22 and the baffles 10, 14. In some special cases it may be possible to achieve slightly closer spacing.

The minimum flow area in the space between adjacent baffles 10, 14 is $$\text{min. flow area} = \text{AFC} \times D_{bc}$$

when $$\text{AFC} = \text{area factor constant} = 2\,(P - D_o)\,N_{tr}$$

and $$D_{bc} = \text{distance between baffles.}$$

Where two sets of rings are used, each with its own ligament size, as shown in FIG. 3, then the AFC of each set is as discussed normally held the same as that of the other set. If ring n is the last ring in one set and ring n−1 is the first ring in the second set, this is accomplished by maintaining $$N_{trn-1} = N_{trn}\left(\frac{P_n - D_o}{P_{n-1} - D_o}\right) \qquad (8)$$

where $P_n$ is the pitch for ring n and $P_{n-1}$ is the pitch for ring n−1. This ensures that the mass flow velocity is nearly constant throughout the tube bundle.

If in special cases it is desired to have a different AFC in each set of tube rings, for example more rapid flow through the outer set than through the inner set, then the AFC can be made larger in the outer set than the inner set.

Figure 5:
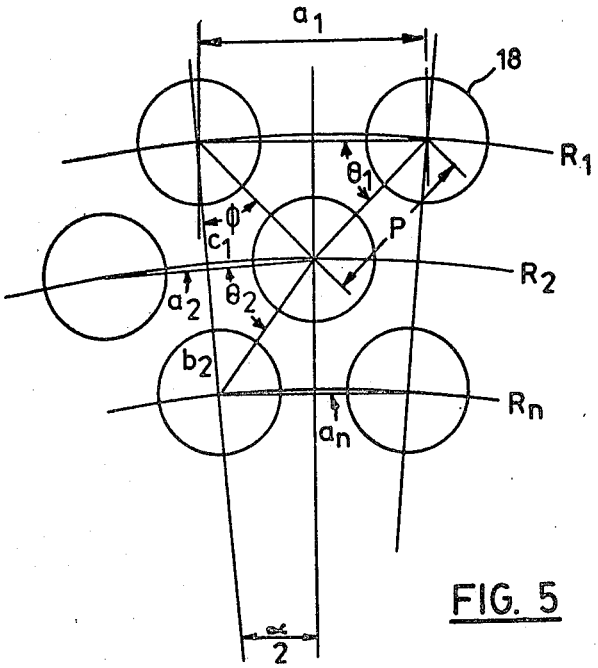
FIG. 5 is a view showing the layout of six tubes according to the invention for calculation of certain limits.

It will be seen from FIGS. 4, 5 that the tubes 18 are laid so that each tube is located circumferentially midway between the two adjacent tubes in each neighboring arc, so that the centres of such three tubes form an isosceles triangle. As shown in FIG. 3, this results in the tubes of each set of rings 26, 28 being laid out in a spiral configuration. This facilitates cleaning, which may be accomplished by inserting a corresponding shaped tool through the tubes between the spirals. When two sets of rings are used, as shown in FIG. 3, then since each set of tubes has a different spiral configuration, it is necessary to clean the outer set of rings by a tool inserted from the outside, and the inner set of rings by a tool inserted from the inside.

In the typical embodiment shown in FIG. 3, each ring R1 to R7 contains 68 tubes (total 476), and the radii are

| | |
|---|---|
| R1 = 35.90 inches | R5 = 30.84 inches |
| R2 = 34.745 inches | R6 = 29.40 inches |
| R3 = 33.51 inches | R7 = 27.90 inches |
| R4 = 32.21 inches | |

The tube outer diameter is 1.5 inches and the pitch is 2.0 inches. In addition each ring R8 to R11 contains 43 tubes, and the radii are

| | |
|---|---|
| R8 = 25.90 inches | R10 = 23.05 inches |
| R9 = 24.54 inches | R11 = 21.43 inches |

The tube outer diameter remains 1.5 inches and the pitch is 2.29 inches. The values given for FIG. 3 are exemplary only and will of course vary depending on the application.

Figure 6:
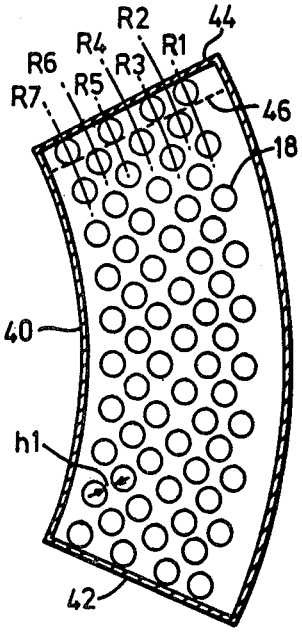
FIG. 6 is a view showing a heat exchanger according to the invention and having the form of a section of an annulus.

In FIG. 3 it is assumed that each set of rings 26, 28 extends through a full circle of 360 degrees, i.e. that each ring R1 to R11 is a closed circle. However if desired the sets of rings 26, 28 may be arranged not as closed rings but as sections of annuli. This arrangement is shown in FIG. 6, where the heat exchanger 2 is shown in section as a section of an annulus and the tubes 18 are arranged along concentric arcs where the arcs do not extend through a full 360 degrees. The FIG. 6 arrangement of tubes is in fact simply a portion of the FIG. 3 set 26, and the same radii R1 to R7 are shown in the drawings. The shell of the heat exchanger is shown at 40.

In the annulus arrangement shown in FIG. 6, all of the relationships previously described remain applicable, except that the arcs may not all have the same number of tubes 18. In FIG. 6 the odd numbered arcs have ten tubes each and the even numbered arcs have nine tubes each. This is because the end walls 42, 44 of the shell are straight and because of the location of such end walls. If end wall 44 were moved to the location shown in dotted lines at 46, then each arc would have the same number of tubes (nine tubes in the FIG. 6 embodiment). Thus, when the tube layout has the form of a section of an annulus, the number of tubes in each arc will be either the same as the number in each other arc or may differ from the number of tubes in each other arc by not more than one. In addition the end tubes in the odd numbered arcs do not of course form an isosceles triangle with the two adjacent tubes of each neighboring arc, because of the end walls 42, 44, but these walls are sufficiently close to the end tubes of the odd numbered arcs to prevent "punch-through".

In the appended claims, reference is made to the distance between tubes. Such distance refers to the distance between the outer diameters of the tubes.

The embodiments of the invention in which an exclusive property or privilege is claimed are defined as follows:

1. In a heat exchanger for exchanging heat between fluids and having a plurality of parallel tubes of circular cross-section, said tubes all having the same outer diameter, the improvement wherein said tubes are laid out according to the following relationship:

(1) said tubes are arranged with their centres located on a set of concentric circular arcs, said set comprising at least first, second and third such arcs, a plurality of tubes on each arc, (2) the number of tubes in each arc differs from the number of tubes in each other arc by not more than one, (3) the tubes in each arc are spaced uniformly apart along such arc, (4) each tube in each arc, other than such end tubes as may be present in some of said arcs, is located circumferentially midway between the two adjacent tubes of each neighboring arc so that the centres of each such three tubes form an isosceles triangle, each tube in each arc being separated from each of said adjacent tubes in each adjacent arc by a diagonal ligament distance h, said distance h being constant for all said tubes, and (5) the distance between each two adjacent tubes in any said arc is at least as great as twice said diagonal ligament distance h, so that the minimum cross-sectional area for radial fluid flow between adjacent arcs of said set is defined as to its circumferential dimension by the sum of said diagonal ligament distances h between the tubes of said adjacent arcs and is substantially constant independent of the radial position of said arcs.

2. A heat exchanger according to claim 1 wherein each said arc extends through 360 degrees so that each arc is a closed circular ring without end tubes, each ring having the same number of tubes as each other ring.

3. A heat exchanger according to claim 2 wherein the radius of one of said rings is $R_n$ and the radius of the next ring radially within said ring is $R_{n+1}$ and said radii are related by the relationship $$R_{n+1}+b_n=R_n \sin \alpha/2$$

substantially within the limit that the radius of the innermost ring $$R\ min \geqq \frac{D_o + 2h}{2 \sin \frac{180}{N_{tr}}}$$

where $b_n$ is the height of a said isosceles triangle between two adjacent tubes in said one ring and one tube in said next ring, $\alpha/2$ is $(180/N_{tr})$ degrees $N_{tr}$ is the number of tubes per ring, $D_o$ is the outer diameter of said tubes.

4. A heat exchanger according to claim 3 wherein said tubes are arranged subject to the restriction that $$R_n-R_{n+2}\geqq D_o+h$$

so that for the outermost ring $R_n$, $$\theta_n\geqq 30°-(180/N_{tr})$$

where $\theta_n$ is the angle between the base and one side of said isosceles triangle between two adjacent tubes in said outermost ring and one tube in the next ring.

5. A heat exchanger according to claim 2 and including a wall defining a shell extending parallel to and encircling said tubes, and first and second baffles each extending at right angles to said wall and intersecting at least some of said tubes, said first baffle extending to said wall and having an inner opening within the innermost of said rings, and hence being of donut configuration, said second baffle being of disc shape and extending from the centre of said innermost ring outwardly past said tubes and having an annular gap between its periphery and said wall, said first and second baffles alternating with each other to form a disc and donut baffle configuration.

6. A heat exchanger according to claim 5 wherein each said baffle intersects all of said tubes.

7. A heat exchanger according to claim 2 including two sets of said rings, each set containing a plurality of rings, the number of tubes in each ring of one set being different from the number of tubes in each ring of the other set.

8. A heat exchanger according to claim 7 wherein said diagonal ligament distance h in said one set is different from said diagonal ligament distance in said other set.

9. A heat exchanger according to claim 8 wherein the number of tubes in each ring of said one set multiplied by said diagonal ligament distance of said one set is equal to the number of tubes in each ring of said other set multiplied by said diagonal ligament distance of said other set, so that said minimum cross-sectional area for said one set is equal to said minimum cross-sectional area for said other set.

10. A heat exchanger according to claim 1 including two sets of said arcs, each said set containing a plurality of arcs, the number of tubes in each arc of one set being different from the number of tubes in each arc of the other set.

11. A heat exchanger according to claim 10 wherein said diagonal ligament distance h in said one set is different from said diagonal ligament size distance in said other set.

12. A heat exchanger according to claim 10 wherein said minimum cross-sectional area for said one set is substantially equal to said minimum cross-sectional area for said other set.

* * * * *